US010941658B2

(12) United States Patent
Pastorino et al.

(10) Patent No.: US 10,941,658 B2
(45) Date of Patent: Mar. 9, 2021

(54) ROCK BOLT ASSEMBLY WITH FAILURE ARRESTOR

(71) Applicant: EPIROC DRILLING TOOLS AB, Orebro (SE)

(72) Inventors: Paolo Ettore Pastorino, Johannesburg (ZA); Rual Abreu, Johannesburg (ZA); Greig Knox, Johannesburg (ZA)

(73) Assignee: EPIROC DRILLING TOOLS AB, Fagersta (SE)

( * ) Notice: Subject to any disclaimer, the term of this patent is extended or adjusted under 35 U.S.C. 154(b) by 0 days.

(21) Appl. No.: 16/609,310

(22) PCT Filed: May 7, 2018

(86) PCT No.: PCT/ZA2018/050021
§ 371 (c)(1),
(2) Date: Oct. 29, 2019

(87) PCT Pub. No.: WO2018/209365
PCT Pub. Date: Nov. 15, 2018

(65) Prior Publication Data

US 2020/0063557 A1 Feb. 27, 2020

(30) Foreign Application Priority Data

May 7, 2017 (ZA) ..... 2017/02442

(51) Int. Cl.
*E21D 21/00* (2006.01)

(52) U.S. Cl.
CPC ..... *E21D 21/0033* (2013.01); *E21D 21/004* (2013.01)

(58) Field of Classification Search
CPC ..... E21D 21/0033; E21D 21/008; E21D 21/0086; E21D 21/0026
(Continued)

(56) References Cited

U.S. PATENT DOCUMENTS 2,525,198 A * 10/1950 Beijl ..... E21D 21/008 411/26
2,950,602 A * 8/1960 Lang ..... E21D 21/008 411/23
(Continued)

FOREIGN PATENT DOCUMENTS

AU 2016101727 A4 11/2016
AU 2016202889 A1 1/2017
(Continued)

OTHER PUBLICATIONS

International Search Report, dated Sep. 13, 2018, from corresponding PCT application No. PCT/ZA2018/050021.

*Primary Examiner* — Frederick L Lagman
(74) *Attorney, Agent, or Firm* — Nixon & Vanderhye

(57) ABSTRACT

A rock anchor assembly includes: a resiliently radially deformable tubular member longitudinally extending between leading and trailing ends and which has an arrestor formation integral with, or engaged to, a trailing end part of the member; an elongate element longitudinally extending through the member between first and second ends and which attaches to the tubular member at spaced distal and proximal load points and which has a failure arrestor fixed at a point within the member; and a faceplate on the tubular member or the elongate member. When the assembly is inserted in a rock hole, with the faceplate bearing against the rock face, and load is applied along the elongate element that will cause the element to sever above the point at which the arrestor is fixed, the failure arrestor engages the arrestor formation, arresting the ejectment of a proximal portion of the elongate element from the hole.

16 Claims, 4 Drawing Sheets

(58) Field of Classification Search
USPC ..... 405/259.2, 259.3, 259.4
See application file for complete search history.

(56) References Cited

U.S. PATENT DOCUMENTS

| | | | | | |
|---|---|---|---|---|---|
| 4,193,715 | A * | 3/1980 | Vass | E21D 20/025 | 405/259.2 |
| 4,664,561 | A * | 5/1987 | Frease | E21D 20/025 | 405/259.3 |
| 6,270,290 | B1 * | 8/2001 | Stankus | E21D 20/025 | 405/259.1 |
| 8,714,883 | B2 * | 5/2014 | Rataj | E21D 21/0033 | 405/259.3 |
| 2007/0031196 | A1 * | 2/2007 | Bruneau | E21D 21/0026 | 405/259.4 |
| 2011/0135402 | A1 * | 6/2011 | Leppanen | E21D 21/008 | 405/259.2 |
| 2012/0155971 | A1 * | 6/2012 | Schmidt | E21D 20/023 | 405/259.6 |
| 2013/0202364 | A1 * | 8/2013 | Ikuno | E21D 21/008 | 405/259.3 |
| 2017/0107815 | A1 | 4/2017 | Rataj et al. | | |
| 2019/0390550 | A1 * | 12/2019 | Abreu | E21D 20/02 | |

FOREIGN PATENT DOCUMENTS

| | | | | |
|---|---|---|---|---|
| CA | 2916043 | A1 * | 2/2015 | E21D 21/008 |
| CA | 3004998 | A1 * | 6/2017 | E21D 21/004 |
| WO | 2017/015677 | A1 | 1/2017 | |

* cited by examiner

ROCK BOLT ASSEMBLY WITH FAILURE ARRESTOR

BACKGROUND OF THE INVENTION

The invention relates to a rock anchor assembly.

In a dynamic load support environment, a rock anchor prevents catastrophic failure of the rock wall, which the anchor supports, by absorbing the energy of the rock movement by stretching. A problem arises in an ungrouted application when the steel material of the rock anchor deforms to its maximum tensile capacity, whereafter the anchor is prone to snap. As the anchor is in tension, the moment the anchor breaks, its proximal severed section has a tendency to eject from the rock hole at great force. This creates a projectile which poses a great danger to mine workers in the vicinity.

The invention aims to overcome the problem by providing a mechanism to arrest the detached portion of steel as it attempts to eject from the support hole.

The present invention at least partially addresses the aforementioned problem.

SUMMARY OF INVENTION

The invention provides a rock anchor assembly which includes:

a resiliently radially deformable tubular member which longitudinally extends between a leading end and a trailing end and which has an arrestor formation integral with, or engaged to, a trailing end part of the member;

an elongate element which longitudinally extends through the member between a first end and a second end and which attaches to the tubular member at spaced distal and proximal load points and which has a failure arrestor fixed at a point within the member;

a faceplate on the tubular member or the elongate member;

wherein, when the assembly is inserted in a rock hole, with the faceplate bearing against the rock face, and load is applied along the elongate element that will cause the element to sever above the point at which the arrestor is fixed, the failure arrestor engages the arrestor formation to arrest the ejectment of a proximal portion of the elongate element from the rock hole.

The arrestor formation may be the trailing end part of the tubular member which has been swaged to taper towards the trailing end. Alternatively, the arrestor formation may be an element, for example a collar or bush, which is engaged with an inner surface of the trailing end portion to reduce the internal diameter of the member.

The elongate element may be an elongate element which is made of a suitable steel material which has a high tensile load capacity.

The elongate element may be adapted with a break formation, for example a notch or an annular groove, between the failure arrestor and the first end, about which the element breaks.

The point at which the failure arrestor is fixed on the elongate element may be predetermined on allowing elongation of the elongate element, to its tensile load capacity, without the failure arrestor coming into contact with the arrestor formation.

The failure arrestor may be a nut, or the like, which is threadedly engaged to the elongate element. Alternatively, the failure arrestor may be a deformation which deforms the elongate element in at least one radial direction, for example a paddled deformation.

The assembly may include a first load bearing formation engaged with the elongate element and the tubular member at the proximal load point.

The arrestor formation may be the first load bearing formation.

The assembly may include an expansion element engaged, or integrally formed, with the elongate element at the distal load point.

The assembly may include a load applicator means engaged with the elongate element between the proximal load point and the second end which is actuable to preload the elongate element in the rock hole between the distal load point and the faceplate.

BRIEF DESCRIPTION OF THE DRAWINGS

The invention is described with reference to the following drawings in which.

DESCRIPTION OF PREFERRED EMBODIMENTS

Figure 1A:
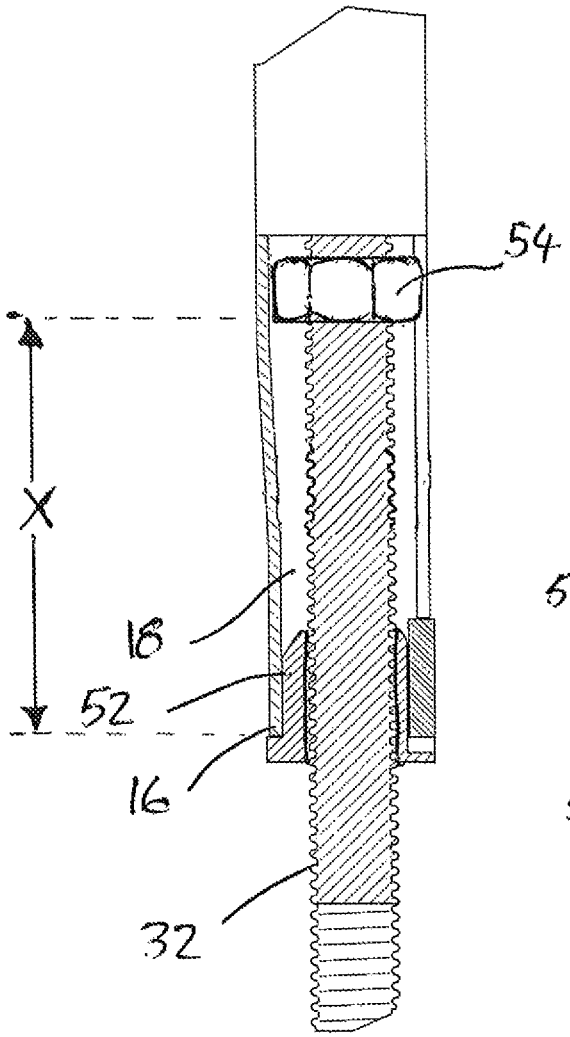
FIG. 1A illustrates a proximal end part of the assembly of FIG. 1 in greater detail.
Figure 1:
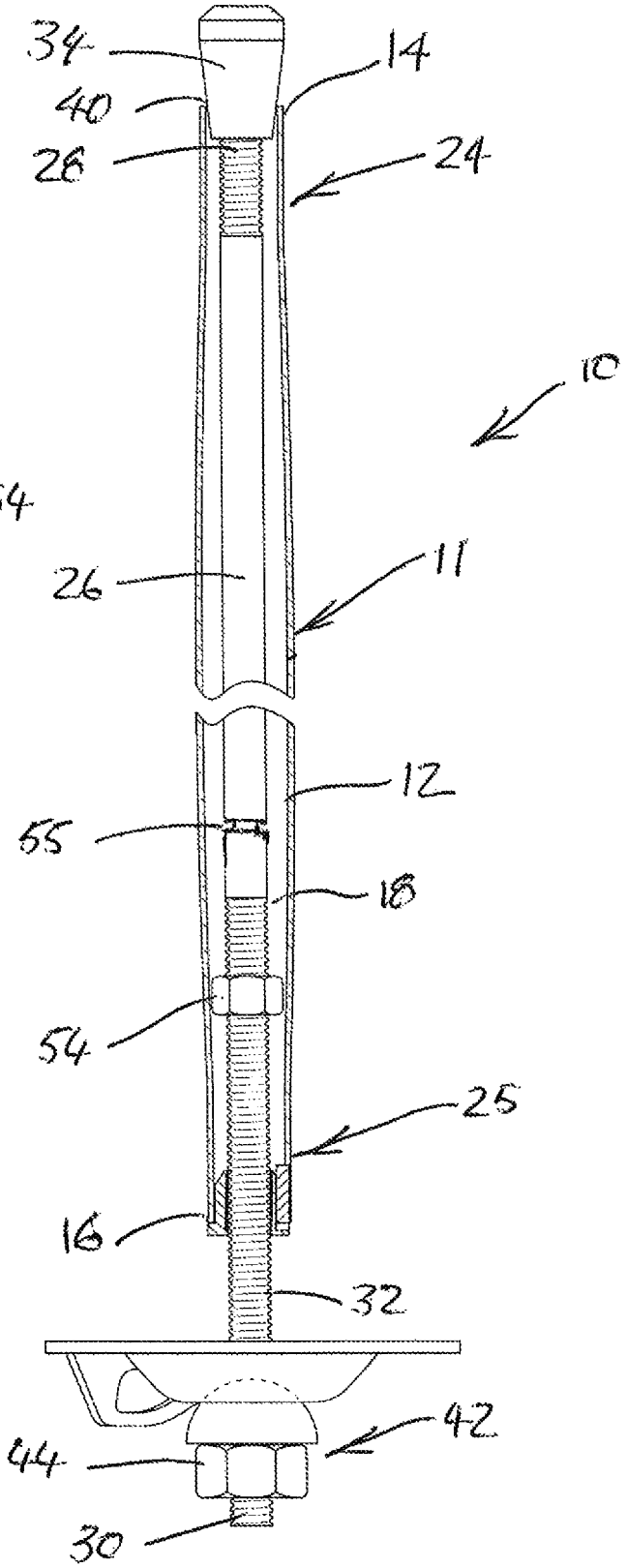
FIG. 1 is a view in elevation of a rock anchor assembly of the invention, with a sleeve of the assembly longitudinally sectioned to show a failure arrestor of the assembly within.
Figure 2A:
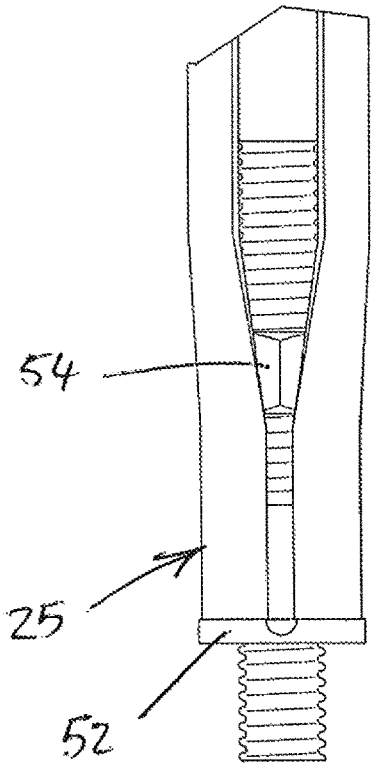
FIG. 2A illustrates a proximal end part of the assembly of FIG. 2 in greater detail.
Figure 2:
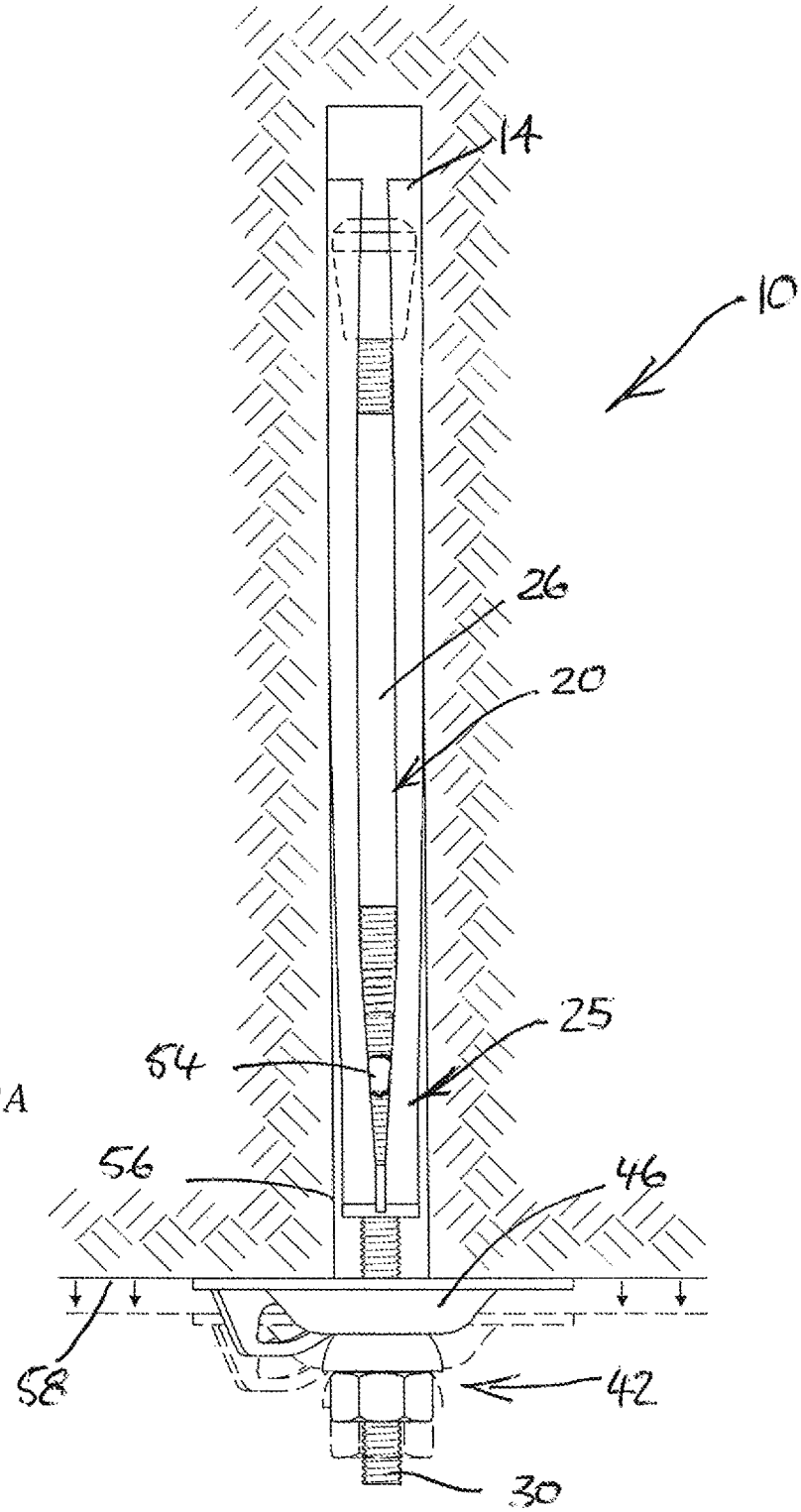
FIG. 2 is a view in elevation of the rock anchor assembly of FIG. 1 inserted in a rock hole in tension, accommodating movement in the rock face.
Figure 3:
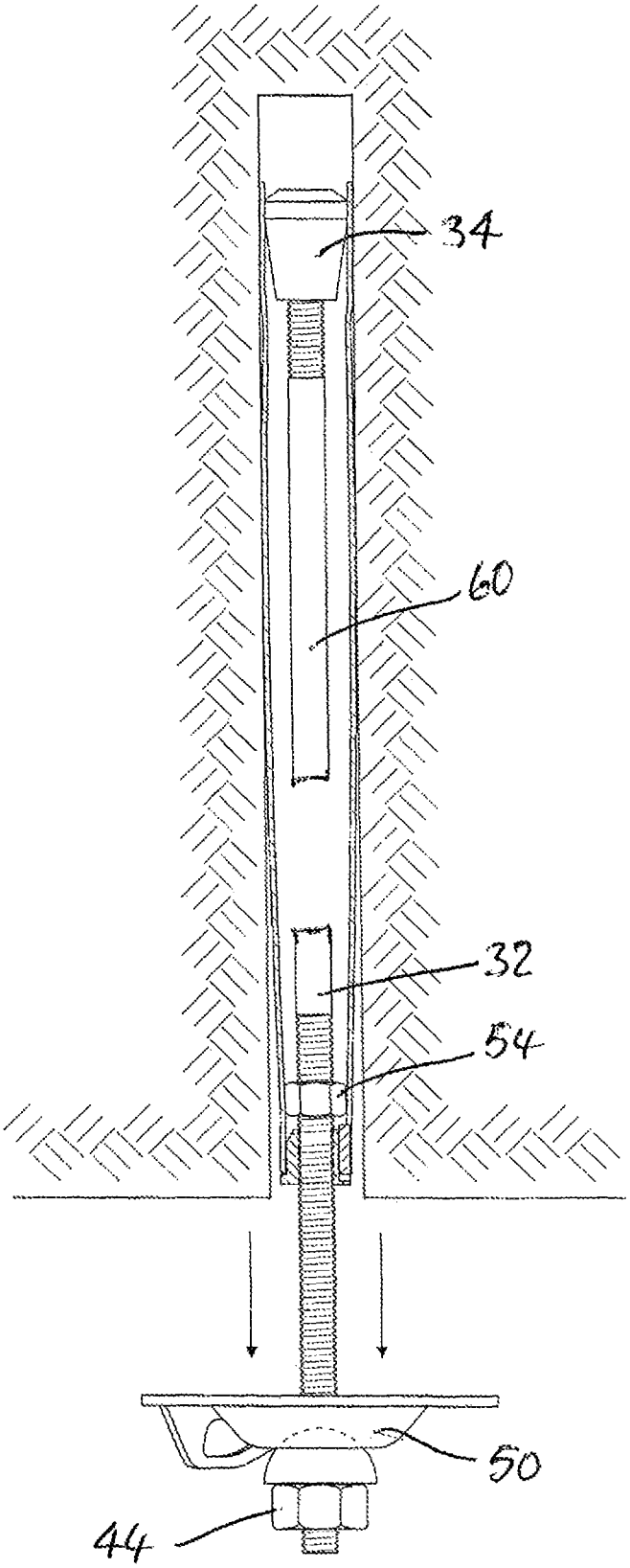
FIG. 3 is a view in elevation view of a rock anchor assembly of FIG. 2 with the sleeve longitudinally sectioned to show a rod of the assembly severed and the arrestor in contact with a tapered part of the sleeve.

A rock anchor assembly 10 according to a first embodiment of the invention is depicted in FIGS. 1 to 3 of the accompanying drawings.

The rock anchor assembly 10 has a resiliently radially deformable sleeve 11 having a generally tubular body 12 that longitudinally extends between a leading end 14 and a trailing end 16. Within the sleeve body, a cavity 18 is defined. The body 12 has a slit 20 extending along the body from a point of origin towards the trailing end 16 and ending at the leading end 14. The slit provides for radial compression of the tubular sleeve body as the body is inserted into a rock hole as will be described in greater detail below.

The sleeve body 12 has a slightly tapered leading portion 24 that tapers toward the leading end 14 to enable the sleeve 11 to be driven into a rock hole having a smaller diameter than the body. At an opposed end, the sleeve body has a tapered trailing portion 25, the function of which will be described below. Between the leading and trailing tapered portions (24, 25), the sleeve body has a consistent internal diameter In this example, the rock anchor assembly 10 includes an elongate element 26 which longitudinally extends between a first end 28 and a second end 30. The elongate element is located partly within the cavity 18 of the sleeve body and has a proximal portion 32 which, at least part of which extends the trailing end 16 of the sleeve body. The proximal portion is threaded. The elongate element is exemplified as a steel rod.

An expansion element 34 is mounted on the first end 28 of the rod 26 at a first end 28. In this example, the expansion element 34 is threadingly mounted onto a threaded leading portion 36 of the rod 26, which rod is received in a blind threaded aperture (not illustrated) of the expansion element 34. The expansion element 34 takes on the general frusto-conical form, with an engagement surface 40 which tapers towards the leading end 14 of the sleeve body. The maximum diameter of the expansion element is greater than the internal diameter of the sleeve body 12.

The rock anchor assembly 10 further includes a load application means 42 mounted on the proximal portion 32 of the rod 26, towards the rod's second end 30. In this example, the means 42 includes a hexagonal nut 44, which is threadedly engaged to the portion 32, and a spherical seat 46, which has a central bore for mounting on the proximal portion 32 of the rod. A last component of the means 42 is a domed face plate 50 which engages with the projecting portion 32, between the seat and the sleeve's trailing end 16.

The rock anchor assembly 10 also includes a retaining fitting 52. In this embodiment, the fitting is a barrel shaped element which press fits into the annular space between the rod 26 and the sleeve 11 to frictionally retain the sleeve in position on the rod. The fitting 52 maintains an initial positioning of the sleeve body 12 relatively to the elongate element 26, with the leading end 14 abutting the expansion element 40. In use of the assembly 10, the fitting becomes load bearing.

The assembly 10 further includes a failure arrestor 54 which is, in this embodiment, a nut which threadedly engages to the proximal portion 32 of the rod, within the sleeve 12. Initially, on assembly of the anchor assembly 10, the arrestor 54 is spaced at a distance, designated X on FIG. 1A, from the sleeve trailing end 16. This distance is a predetermined distance, the considerations in this pre-determination are explained below.

Between the failure arrestor 24 and the first end 28 of the rod 26, the rod is formed with an annular rebate 55 about which the rod is designed to break in circumstances described below.

In use, the assembly 10 is installed in a rock hole 56 predrilled into a rock face 58 behind which adjacent rock strata layers require stabilization. See FIG. 2. The rock hole will be of a diameter that is slightly smaller than the diameter of the body 12 of the sleeve 10, although greater than the maximum diameter of the expansion element 34 to allow unhindered insertion of the assembly into the rock hole. Facilitated by the slit 20, the sleeve body 12 compressively deforms, to accommodate passage into the rock hole. Initially, the frictional forces resulting from the interference fit between the sleeve body 12 and the rock hole walls retain the rock anchor assembly 10 in the hole, and allow for the transfer of proportional load from the rock strata about the rock face 58 to the sleeve body 12.

The assembly 10 is fully and operationally installed in the rock hole 54 when both the sleeve is wholly contained therein, but with a length of the projecting portion 32 of the elongate element 26 extending from the rock hole 54. On this length, the face plate 50, the nut 44 and the spherical seat 46 are located, initially with the face plate 50 free to move axially on the rod between the rock face 56 and the trailing position of the barrel 46.

Active anchoring of the sleeve body 12 in the rock hole 50, additional to that provided passively by frictional fit, is achieved by pull through of the expansion element 34 into and through the sleeve body 12. This provides a point anchoring effect. The expansion element is caused to move by actuating the load application means 42 by applying a drive means (not shown) to spin and then torque the hex nut 44. Initially the nut is spun into contact with the face plate 50 and then to push the faceplate into abutment with the rock face 58. Due to opposed thread direction on a leading end portion and the projecting portion 32 of the rod, this rotation does not lead to disengagement of the elongate element with the expansion element.

Torqueing of the hex nut 44, now abutting the faceplate 50, will draw the threaded projecting portion 32 of the elongate element 26 through the nut and pull the attached expansion element 34 against the leading end 14 of the sleeve body 12. Reactively, as the hex nut 44 is torqued, the faceplate 50 is drawn and held in progressive and proportional load support with the rock face 58.

Before the expansion element 34 moves into the cavity 18, the element contacts the leading end 14 of the sleeve body 12 in bearing engagement which causes the trailing end of the sleeve to reactively engage the fitting 52. The fitting 52, now in load support of the sleeve 12, prevents the sleeve 11 from giving way axially relatively to the elongate element 26 due to ingress of the expansion element 34.

With the sleeve 11 held stationary relatively to the elongate element 26, the expansion element engages the sleeve body 12 at the leading end and forces the body 12 at this end into radially outwardly deformation. Ultimately, the expansion element 34 is caused to be drawn fully into the tapered leading portion 24 of the sleeve body 12, as illustrated in FIGS. 2 and 3, which radially outwardly deforms along the path of ingress to accommodate the passage of the element 34. The radial outward deformation forces the sleeve body 12 into frictional contact with walls of the rock hole 56. This action achieves anchoring of the sleeve body 12, and thus the anchor assembly 10, within the rock hole.

The faceplate 50 is in load support of the rock face 58 and is thus subjected to a moving face (illustrated in FIG. 2) due to quasi-static or seismic loading, whilst the first end 28 of the elongate element 26 is anchored within the sleeve which in turn is anchored within the rock hole. Anchored at one end, and pulled at the other, the rod 26 elongates thereby absorbing the energy of the static and seismic forces.

The failure arrestor 54 will move with the rod 26, as it stretches, through the sleeve towards the trailing end. The initial spacing X is pre-set so that the rod is allowed to stretch to close to its maximum tensile capacity, absorbing maximum energy, without the arrestor coming into contact with the diametrically reduced tapered trailing portion 25 of the sleeve. At the point where the elongate element 26 breaks, at maximum loading, the arrestor will be positioned just short of the start of the tapered trailing portion 25 (see FIG. 2A).

When the rod finally breaks, at the rebate 55, the proximal portion 32 of the elongate element 26 separates from a remaining part 60 (see FIG. 3) of the rod. The arrestor 54, being diametrically larger than the width of the internal diameter of portion 25, will come into resistive contact with the walls of this portion, arresting the proximal portion 32 from being ejected from the hole 56 by the static or seismic forces. This is shown in FIG. 3.

Frictional interaction of the arrestor 54 with the tapered portion 25 provides a load carrying structure secondary to the primary load carrying structure provided by the interaction of the expansion element 34 with the sleeve body 12 along the leading tapered portion 24. This allows a mine worker to return and rehabilitate the rock mass that was subjected to static deterioration or seismic damage in a manner described below.

With static deterioration or seismic damage, the rock strata underlying the rock face 58 will fragment and scale from the rock face. But, due to the arrested projecting portion 32 of the elongate element, and the space now created between the faceplate 50 and the sleeve, there is a capacity to re-tension the assembly 10 by spinning the nut 44, the faceplate 50 is driven back into contact with a now retreated rock face 58. Torqueing the nut will ensure that tension is reinstated in the assembly 10 between the arrestor 54 and the faceplate, thereby reintroducing some supporting reactionary force through the faceplate 50 to the rock face 58.

Figure 4:
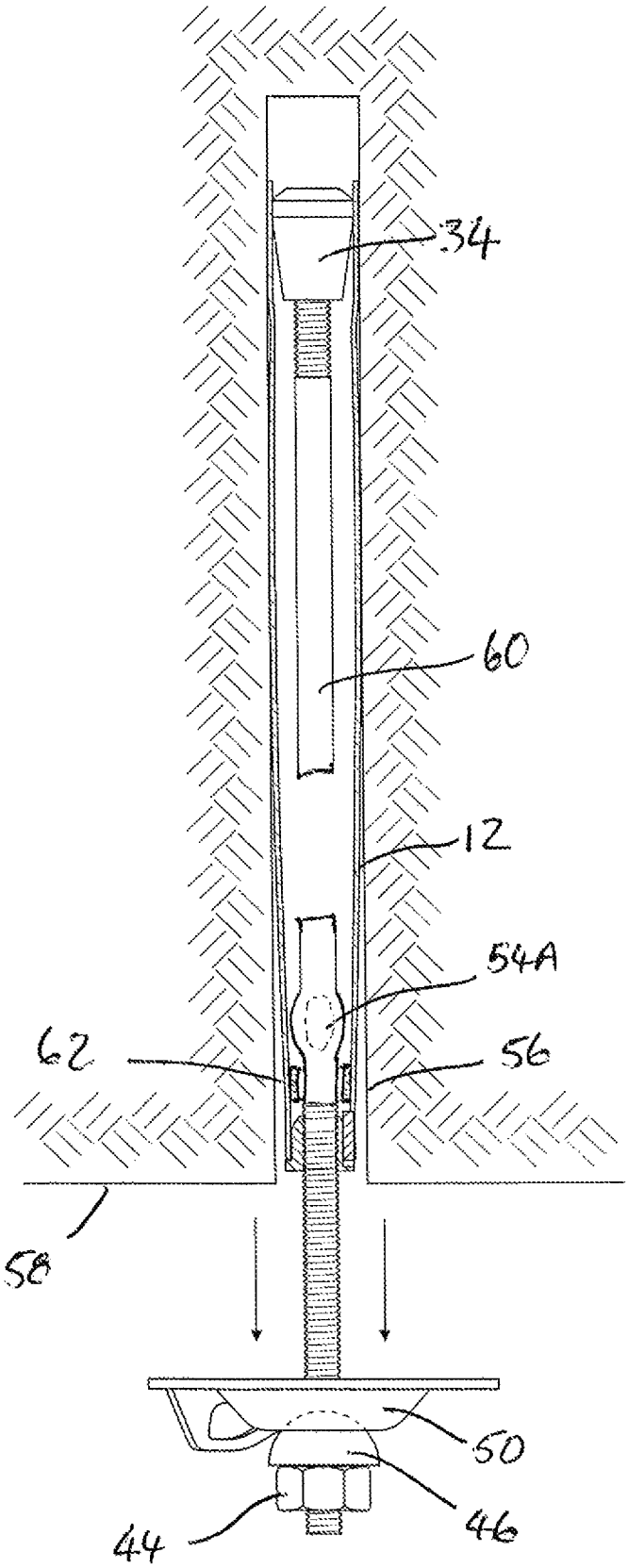
FIG. 4 is a view in elevation view of a rock anchor assembly in accordance with a second embodiment of the invention, again with the sleeve longitudinally sectioned to show a rod of the assembly severed but with the arrestor in contact with a bush.

A second embodiment of the rock anchor assembly 10A is illustrated in FIG. 4. In describing this embodiment, like features bear like designations. Only the differences over the earlier embodiment are described.

The assembly 10A includes an arrestor element 62, such as a collar of bush, which is welded to the inside surface of the proximal portion 25 of the sleeve 11. Although a tapered proximal portion is illustrated in this figure, this tapering is not essential and, instead, the sleeve diameter reduction is achieved with the arrestor element.

It is against this element that the failure arrestor comes into contact. In this embodiment, the failure arrestor 54A is a paddle shaped adaptation of the rod 26.

In the embodiments described above, the sleeve 11 and the elongate element 26 are made of structural grade steel. This is non-limiting to the invention as it is envisaged that at least the sleeve 11 and the elongate element 26 can also be made of a fibre reinforced plastic (FRP) such as, for example, pultruded fibreglass. It is further anticipated that all of the components of the components of the rock anchor assembly (10, 10A) can be made off a FRP.

The invention claimed is:

1. A rock anchor assembly comprising:

a resiliently radially deformable tubular member which longitudinally extends between a leading end and a trailing end and which has an arrestor formation integral with, or engaged to, a trailing end part of the tubular member;

an elongate element which longitudinally extends through the tubular member between a first end and a second end and which attaches to the tubular member at spaced distal and proximal load points and which has a failure arrestor fixed at a point within the tubular member;

a faceplate on the tubular member or the elongate member;

wherein, when the assembly is inserted in a rock hole, with the faceplate bearing against the rock face, and a load is applied along the elongate element that will cause the element to sever above the point at which the failure arrestor is fixed, the failure arrestor engages the arrestor formation to arrest the ejectment of a proximal portion of the elongate element from the rock hole, wherein the arrestor formation is the trailing end part of the tubular member which has been swaged to taper towards the trailing end.

2. A rock anchor assembly according to claim 1, wherein the failure arrestor is a nut which is threadedly engaged to the elongate element.

3. A rock anchor assembly according to claim 1, which includes an expansion element engaged, or integrally formed, with the elongate element at the distal load point.

4. A rock anchor assembly according to claim 1, which includes a load applicator means engaged with the elongate element between the proximal load point and the second end and which is actuable to preload the elongate element in the rock hole between the distal load point and the faceplate.

5. A rock anchor assembly according to claim 1, wherein the point at which the failure arrestor is fixed on the elongate element is predetermined on allowing elongation of the elongate element, to a tensile load capacity of the elongate element, without the failure arrestor coming into contact with the arrestor formation.

6. A rock anchor assembly according to claim 1, wherein the elongate element is adapted with a break formation between the failure arrestor and the first end.

7. A rock anchor assembly comprising:

a resiliently radially deformable tubular member which longitudinally extends between a leading end and a trailing end and which has an arrestor formation integral with, or engaged to, a trailing end part of the tubular member;

an elongate element which longitudinally extends through the tubular member between a first end and a second end and which attaches to the tubular member at spaced distal and proximal load points and which has a failure arrestor fixed at a point within the tubular member;

a faceplate on the tubular member or the elongate member;

wherein, when the assembly is inserted in a rock hole, with the faceplate bearing against the rock face, and a load is applied along the elongate element that will cause the element to sever above the point at which the failure arrestor is fixed, the failure arrestor engages the arrestor formation to arrest the ejectment of a proximal portion of the elongate element from the rock hole, wherein the point at which the failure arrestor is fixed on the elongate element is predetermined on allowing elongation of the elongate element, to a tensile load capacity of the elongate element, without the failure arrestor coming into contact with the arrestor formation.

8. A rock anchor assembly according to claim 7, wherein the elongate element is adapted with a break formation between the failure arrestor and the first end.

9. A rock anchor assembly comprising:

a resiliently radially deformable tubular member which longitudinally extends between a leading end and a trailing end and which has an arrestor formation integral with, or engaged to, a trailing end part of the tubular member;

an elongate element which longitudinally extends through the tubular member between a first end and a second end and which attaches to the tubular member at spaced distal and proximal load points and which has a failure arrestor fixed at a point within the tubular member;

a faceplate on the tubular member or the elongate member;

wherein, when the assembly is inserted in a rock hole, with the faceplate bearing against the rock face, and a load is applied along the elongate element that will cause the element to sever above the point at which the failure arrestor is fixed, the failure arrestor engages the arrestor formation to arrest the ejectment of a proximal portion of the elongate element from the rock hole, wherein the elongate element is adapted with a break formation between the failure arrestor and the first end.

10. A rock anchor assembly comprising:

a resiliently radially deformable tubular member which longitudinally extends between a leading end and a trailing end and which has an arrestor formation integral with, or engaged to, a trailing end part of the tubular member;

an elongate element which longitudinally extends through the tubular member between a first end and a second end and which attaches to the tubular member at spaced distal and proximal load points and which has a failure arrestor fixed at a point within the tubular member;

a faceplate on the tubular member or the elongate member;

wherein, when the assembly is inserted in a rock hole, with the faceplate bearing against the rock face, and a load is applied along the elongate element that will cause the element to sever above the point at which the failure arrestor is fixed, the failure arrestor engages the arrestor formation to arrest the ejectment of a proximal portion of the elongate element from the rock hole, wherein the failure arrestor is a deformation which deforms the elongate element in at least one radial direction.

11. A rock anchor assembly comprising:

a resiliently radially deformable tubular member which longitudinally extends between a leading end and a trailing end and which has an arrestor formation integral with, or engaged to, a trailing end part of the tubular member;

an elongate element which longitudinally extends through the tubular member between a first end and a second end and which attaches to the tubular member at spaced distal and proximal load points and which has a failure arrestor fixed at a point within the tubular member;

a faceplate on the tubular member or the elongate member;

wherein, when the assembly is inserted in a rock hole, with the faceplate bearing against the rock face, and a load is applied along the elongate element that will cause the element to sever above the point at which the failure arrestor is fixed, the failure arrestor engages the arrestor formation to arrest the ejectment of a proximal portion of the elongate element from the rock hole, wherein the arrestor formation is a collar or bush which is engaged with an inner surface of the trailing end portion to reduce the internal diameter of the tubular member, and wherein the point at which the failure arrestor is fixed on the elongate element is predetermined on allowing elongation of the elongate element, to a tensile load capacity of the elongate element, without the failure arrestor coming into contact with the arrestor formation.

12. A rock anchor assembly according to claim 11, which includes a first load bearing formation engaged with the elongate element and the tubular member at the proximal load point.

13. A rock anchor assembly according to claim 12 wherein the first load bearing formation is the arrestor formation.

14. A rock anchor assembly according to claim 13, wherein the elongate element is adapted with a break formation between the failure arrestor and the first end.

15. A rock anchor assembly according to claim 12, wherein the elongate element is adapted with a break formation between the failure arrestor and the first end.

16. A rock anchor assembly according to claim 11, wherein the elongate element is adapted with a break formation between the failure arrestor and the first end.

* * * * *